US007819281B2

(12) United States Patent
Guindulain Busto

(10) Patent No.: US 7,819,281 B2
(45) Date of Patent: Oct. 26, 2010

(54) UNITARY EXTRACTOR SYSTEM OF PRODUCTS FOR VENDING MACHINES

(75) Inventor: Felix Guindulain Busto, Peralta (ES)

(73) Assignee: Jofemar, S.A., Peralta (Navarra) (ES)

( * ) Notice: Subject to any disclaimer, the term of this patent is extended or adjusted under 35 U.S.C. 154(b) by 212 days.

(21) Appl. No.: 12/076,078

(22) Filed: Mar. 13, 2008

(65) Prior Publication Data

US 2008/0223870 A1 Sep. 18, 2008

(30) Foreign Application Priority Data

Mar. 16, 2007 (ES) ..... 200700703

(51) Int. Cl.
*G07F 11/62* (2006.01)

(52) U.S. Cl. ..... 221/120; 221/279

(58) Field of Classification Search ..... 221/69, 221/76, 79–82, 84–86, 92, 103, 110, 112–114, 221/119–121, 123, 208, 241, 243, 253, 268, 221/270, 272, 275, 277, 279

See application file for complete search history.

(56) References Cited

U.S. PATENT DOCUMENTS

| | | | | | |
|---|---|---|---|---|---|
| 1,052,607 | A * | 2/1913 | McBride | 221/78 |
| 2,253,447 | A * | 8/1941 | Stanford | 221/15 |
| 2,446,788 | A * | 8/1948 | Rifkin | 62/234 |
| 2,460,396 | A * | 2/1949 | Rifkin | 221/279 |
| 2,500,438 | A * | 3/1950 | Tandler et al. | 221/13 |
| 2,522,896 | A * | 9/1950 | Rifkin et al. | 221/260 |
| 2,590,736 | A * | 3/1952 | Tandler et al. | 194/244 |
| 3,185,280 | A * | 5/1965 | Nathan et al. | 194/245 |
| 3,487,945 | A * | 1/1970 | Barham | 211/43 |
| 3,679,064 | A * | 7/1972 | Howkinson | 211/43 |
| 3,767,084 | A * | 10/1973 | Bayha | 221/279 |
| 3,831,807 | A * | 8/1974 | Deaton et al. | 221/85 |
| 4,108,333 | A * | 8/1978 | Falk et al. | 221/13 |
| 4,134,520 | A * | 1/1979 | Collins et al. | 221/129 |
| 4,221,376 | A * | 9/1980 | Handen et al. | 271/149 |
| 4,257,531 | A * | 3/1981 | Kimura et al. | 221/227 |
| 4,343,450 | A * | 8/1982 | Anderson | 248/454 |
| 4,742,936 | A * | 5/1988 | Rein | 221/5 |
| 5,009,328 | A * | 4/1991 | Bergsten | 221/152 |
| 5,046,641 | A * | 9/1991 | Gray | 221/253 |
| 5,190,186 | A * | 3/1993 | Yablans et al. | 221/124 |
| 6,253,954 | B1 * | 7/2001 | Yasaka | 221/93 |
| 6,357,621 | B1 * | 3/2002 | Vidondo | 221/85 |
| 6,598,732 | B2 * | 7/2003 | Vidondo | 198/728 |
| 6,691,891 | B2 * | 2/2004 | Maldonado | 221/279 |

(Continued)

*Primary Examiner*—Gene Crawford
*Assistant Examiner*—Kelvin L Randall, Jr.
(74) *Attorney, Agent, or Firm*—Wenderoth, Lind & Ponack, L.L.P.

(57) ABSTRACT

A unitary extractor system of products for vending machines, which products are to be found stored in compartments or ducts of different trays, includes a traction belt mounted in the open central part of the base of each compartment or duct, to which belt are joined a diversity of separator pieces for the products. The traction belt (5) incorporates a plurality of small pieces (6), with a slight inclination towards the rear part, joined to respective teeth, and a support body (7) for the last product (2) to dispense, with its support surface slightly inclined towards the rear part. The body (7) is secured to the teeth of the traction belt (5) as it advances, and in such a way that it is pulled on the lateral surfaces (4) making up the base of the compartment or duct (1).

8 Claims, 7 Drawing Sheets

U.S. PATENT DOCUMENTS 6,823,997 B2 * 11/2004 Lindén et al. ..... 211/59.3
7,500,571 B2 * 3/2009 Hawkinson ..... 211/59.3
2002/0125266 A1 * 9/2002 Vidondo ..... 221/76
2002/0148794 A1 * 10/2002 Marihugh ..... 211/59.3
2003/0000956 A1 * 1/2003 Maldonado ..... 221/120
2006/0261081 A1 * 11/2006 Vidondo ..... 221/124

* cited by examiner

UNITARY EXTRACTOR SYSTEM OF PRODUCTS FOR VENDING MACHINES

BACKGROUND OF THE INVENTION

As stated in the title of this specification, the following invention relates to a unitary extractor system of products for vending machines, being of utility for its incorporation in all manner of automatic vending machines functioning by means of the introduction of coins, permitting the unitary vending of a wide variety of products, independently of their shape, configuration and structural consistency.

So, the products, separated by small pieces between them, rest one on another, with the last of them resting on a support body for the products, while in the upper forward part of the duct it incorporates a stud for stopping of the products, preventing any possible fall of the products whether intentional or accidental.

The present specification describes a unitary extractor system of products for vending machines, being of application in all manner of automatic vending machines functioning by means of the introduction of coins, banknotes and/or cards and which can dispense drinks and food products, refrigerated or otherwise.

In this way, the vending machine will be able to be installed in very different places, and can thus be installed in companies, public bodies, hospitals, airports, railway and bus stations, schools, etc.

The vending machine will likewise be able to be of utility for the vending of live bait, and can be installed in shops and shopping centers, especially in sections relating to fishing and in fishing zones.

As is known, there exists on the market a wide diversity of automatic vending machines which function by means of the introduction of coins, cards and/or banknotes and which can incorporate cold equipment, in such a way that, considering those machines that incorporate cold equipment and are used for the vending of cold drinks or food products which, on account of their components, need to be kept at low temperature until their consumption, it can be cited those machines that present certain bodies that rotate between two shafts, one upper and the other lower, provided with some cross-shaped arms which act as compartments housing the products to dispense.

In this type of vending machines the distance between the arms defining the compartments is fixed so it can happen, depending on the product it is wished to locate, that its own volume means that there is a lot of space unused.

Patents ES 2025473 and ES 2066691 can also be cited in which the products to dispense are stored in a vertical standing position in respective compartments in a spiral, in such a way that with the successive turning of the platform for holding the products these products are extracted by means of the corresponding extraction mechanism.

Patent ES 2113824 can equally be cited in which the products, cold drinks, are stored in the horizontal position, in a series of compartments inclined towards an open vertical duct which leads to an extractor mechanism.

Likewise, Patent ES 2137895 can be cited which presents a "Vending machine", provided with a series of trays with certain compartments, with their base open centrally, in relation to which opening there is a chain between two shafts, the system of pulling the products being defined by a series of bodies secured to that chain with respective transverse plates being rotationally attached to those bodies, those plates pushing the products as the chain advances driven by the corresponding motor which transmits movement to one of the shafts.

The transverse plates pushing the products in their expulsion remain on the base of the compartment housing the products in the vertical position and via their lower part they rotate with respect to the pieces fixed to the chain, occupying a small space.

Patent ES 2150385 presents a system for pulling products defined by some belts arranged in the open central part of the base where the products are stored, these belts being provided with a series of projections containing corresponding holes, to which are rotationally attached the flat-bars for the actual pulling of the products, in such a way that the pulling flat-bars for the products present a rectangular general shape with a central recess in relation to their side for backing on to the base of the compartment and of length similar to the width of the belt, being provided in relation to the end of the sides of that recess with respective lugs for their rotational attachment to the corresponding hole of the respective projection of the belt.

Patent ES 2160544 presents certain flat-bars for the actual pulling of the products which, in relation to their central recess are provided with some flaps towards the outside with some stopping lugs on the lower surface of the base for storage of the products.

Likewise Patent Application P200501205 can be cited in which, starting from the same concept of vending machine, the pulling mechanism for the products is defined by a single piece secured to the belt and a pair of lateral straps in the forward part of the compartment, the width of the compartment being related to the width of the products stored therein.

SUMMARY OF THE INVENTION

The present specification describes a unitary extractor system of products for vending machines, which products are stored in compartments of different trays, the extractor system comprising a timing belt mounted in the open central part of the base of each compartment or duct, to which belt, with its teeth provided with respective holes, are joined a diversity of separator pieces for the products, in such a way that the traction belt incorporates:

- a plurality of small pieces, with a slight inclination towards the rear part, joined to respective teeth; and
- a support body for the last product to dispense, with its support surface slightly inclined towards the rear part, the body being secured to the teeth of the traction belt as it advances, being pulled on the lateral surfaces making up the base of the duct, the support body presenting a central window with a contour slightly larger than that of the small separator pieces, being provided in the upper forward part of the duct, in the transverse position, with a stud for stopping of the products.

The plurality of small separator pieces for the products present, centrally and below, at least one flange for seating on the traction belt, which are mounted with a slight inclination towards the rear part, in the static position.

Moreover, the support body for the last product to dispense presents laterally to and below its central window, separate elongated flat-bars, in the manner of skis, for support on the lateral surfaces making up the base of the duct, presenting in their forward lower parts orthogonal projections towards the interior provided with respective protuberances for fitting between two teeth of the traction belt.

In this way, the simple fitting of those protuberances between corresponding teeth of the traction belt, and with the collaboration of the actual weight of the products, permits the pulling of the support body for the products without any problem.

Once the last product has been dispensed, the support body for the products runs up against the forward part of its lateral flat-bars, permitting free rotation of the traction belt.

This is so with the aim of preventing possible breakdowns of the system since, in the event of the system being actuated, usually by error, even though there is no product to dispense and the support body is fixed, the traction belt will advance.

In the operation of loading with the traction belt static, the support body is manually displaced as far as the rear part of the duct, passing the small separator pieces via their lower central window.

This operation permits displacement of the support body for the products due to the simple elasticity of the belt which does not support any weight at all.

In order to complement the description to be made forthwith, and with the aim of aiding a better understanding of the characteristics of the invention, this descriptive specification is accompanied by a set of drawings in which, on an illustrative rather than limiting basis, the most characteristic details of the invention are represented.

DESCRIPTION OF A PREFERRED EMBODIMENT

Figure 1:
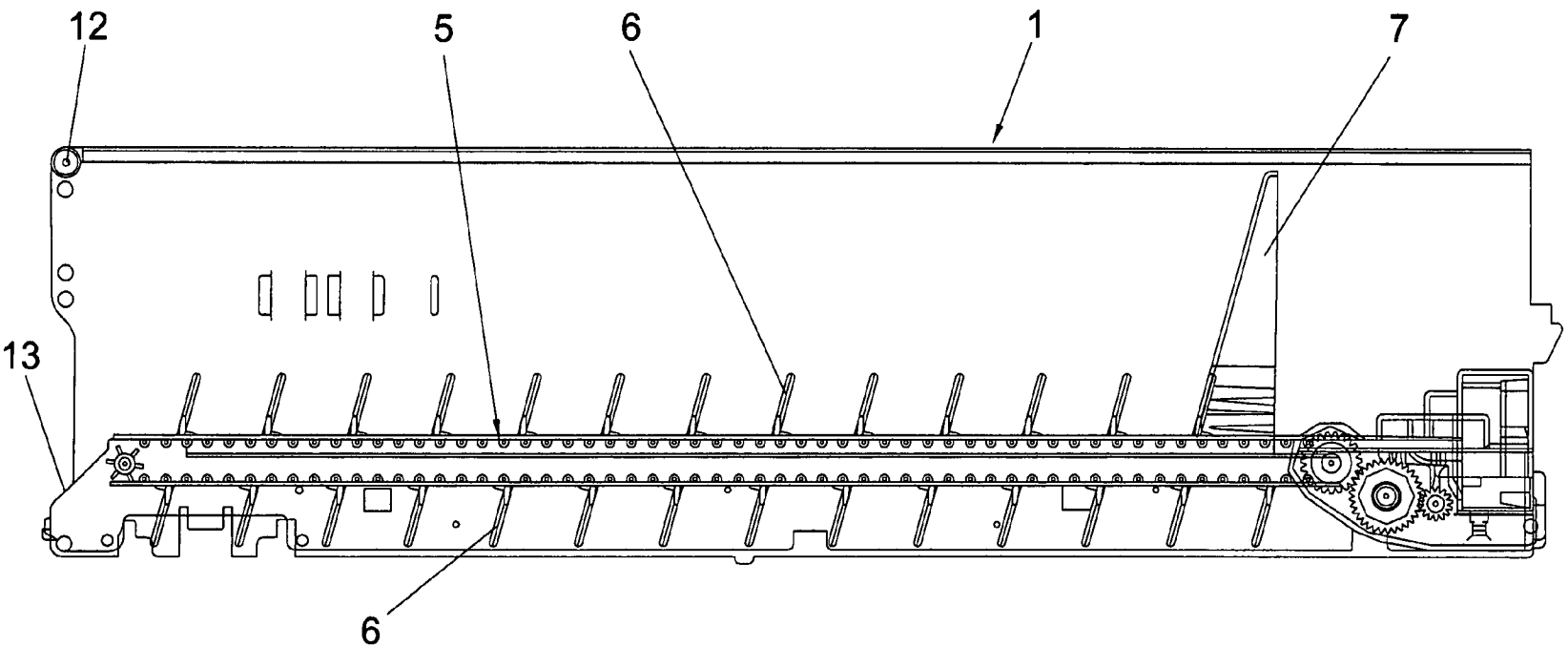
FIG. 1 shows a view in side elevation of an extractor system relative to a duct for storing the products to be dispensed, wherein can be seen a traction belt provided with a plurality of small separator pieces and a support body for the products.

In view of the above-mentioned figures and in accordance with the adopted numbering, it can be seen how the extractor system is based on a structure in which an automatic vending machine incorporates a series of trays with a diversity of compartments or ducts 1 for storing the corresponding products 2 to dispense and which ducts 1 present a base provided with a central opening 3 which defines separate lateral surfaces 4, in such a way that, in relation to the central opening 3, a traction belt 5 is fitted engaged between a pair of gears, which traction belt, comprising teeth with holes, incorporates a plurality of small pieces 6, with a slight inclination towards the rear part, attached to respective teeth of the traction belt.

The small pieces 6 are attached by a pair of pivots fitting in the ends of the holes made in the teeth of the traction belt 5.

Likewise, the traction belt 5 incorporates a support body 7 for the last product to be dispensed with its support surface for the product having a slight inclination towards the rear part, in such a way that the support body 7 is secured to the teeth of the traction belt 5 in the latter's advance, being pulled along the lateral surfaces 4 making up the base of the duct, the support body 7 presenting a central window 8 with a contour slightly larger than that of the small separator pieces 6.

The plurality of small separator pieces 6 for the products present, centrally and below, at least one flange 14 for seating on the traction belt 5, which are mounted with a slight inclination towards the rear part, in the static position.

Figure 3:
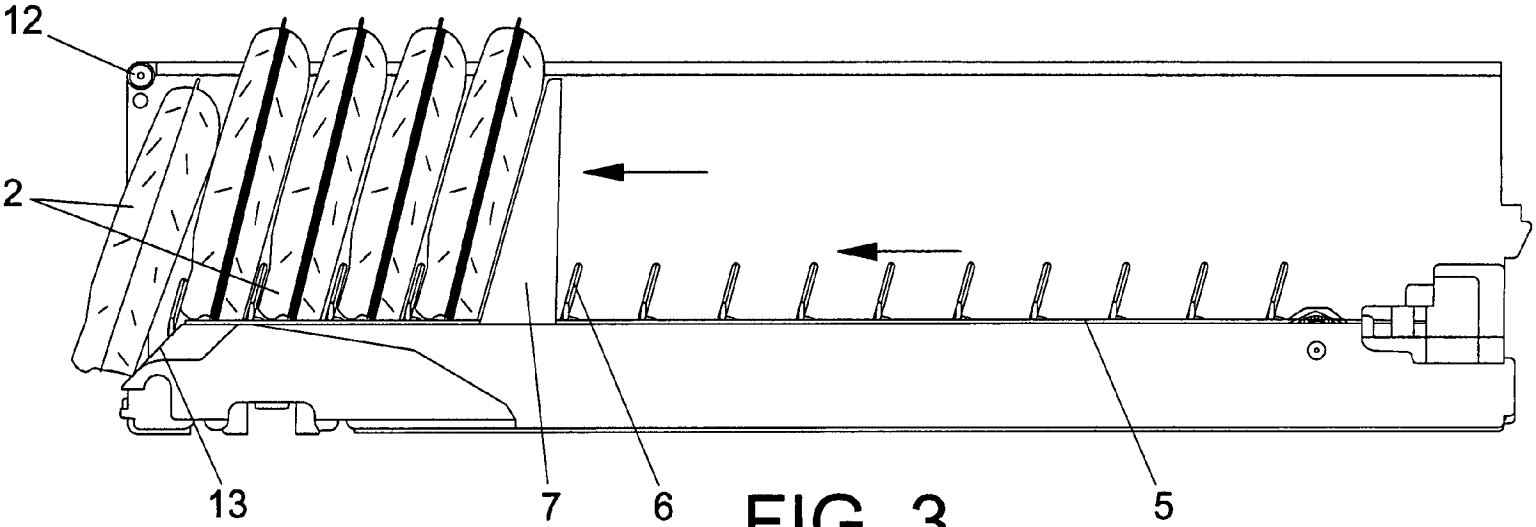
FIG. 3 shows a view in side elevation of the extractor system relative to a duct for storing the products to be dispensed, wherein can be seen certain products resting on the support body and separated by the corresponding separator pieces.

In this way, independently of the consistency which the products might have, they will be able to be stored slightly inclined and resting one on another, as shown in FIG. 3 of the designs, with the last product resting on the support body 7.

So, the vending is facilitated of all those products which do not present a certain rigidity, such as container bags for aperitif products like crisps, nuts, sweets and similar.

Figure 4:
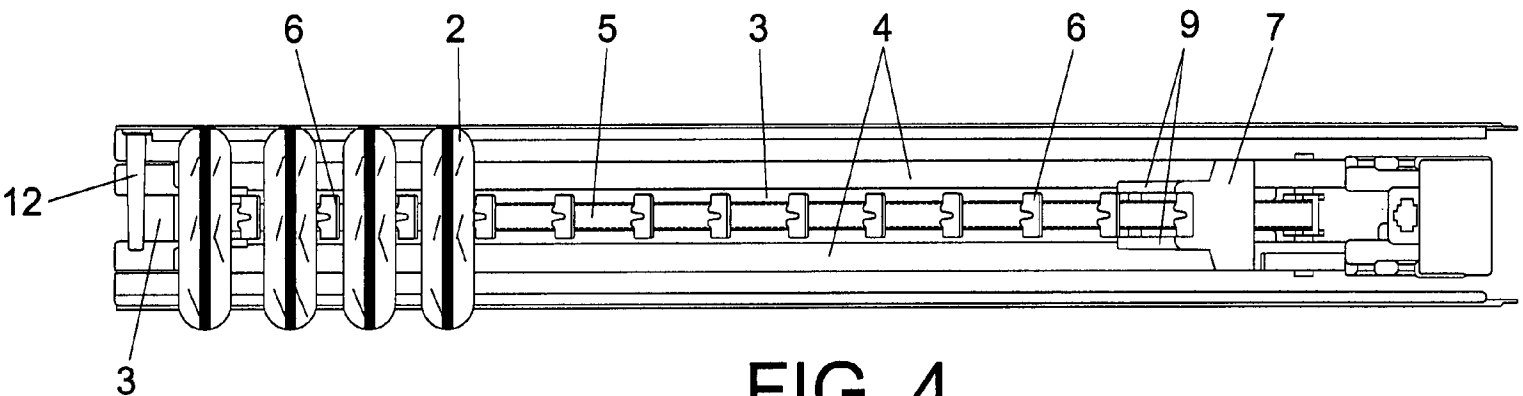
FIG. 4 shows a view in plan of the extractor system relative to a duct for storing the products to be dispensed, wherein can be seen certain products in the vertical position and a stud mounted in the upper forward part of the duct as a stop for the products to dispense.

Of course, it is also of utility for products that can remain in a perfect vertical position, as seen in FIG. 4 of the designs. So, the small separator pieces 6 will also be able to be manufactured in such a way that, when fitted to the traction belt they remain in the vertical position, with the support body likewise being able to present a support for the vertical products.

Moreover, the support body 7 for the last product to dispense presents laterally to and below its central window 8, separate elongated flat-bars 9, in the manner of skis, for support on the lateral surfaces 4 making up the base of the duct 1, presenting in their forward lower parts orthogonal projections 10 towards the interior with both projections 10 being provided with respective protuberances 11 for fitting between two teeth of the traction belt 5.

In this way, the simple fitting of those protuberances 11 between corresponding teeth of the traction belt, and with the weight of the products 2, permits the pulling of the support body 7 for the products without any problem.

Once the last product has been dispensed, the support body 7 runs up against the forward part of its lateral flat-bars 9, permitting free rotation of the traction belt 5.

This is so with the aim of preventing possible breakdowns of the system since, in the event of the system being actuated, usually by error, even though there is no product to dispense and the support body 7 is fixed, the traction belt 5 can advance without problems.

In the operation of loading with the traction belt 5 static, the support body 7 is manually displaced as far as the rear part of the duct 1, passing the small separator pieces 6 via their lower central window 8.

This operation permits displacement of the support body 7 for the products due to the simple elasticity of the belt 5 which does not support any weight at all.

With the aim of collaborating in the vending of the lateral surfaces 4 of the base of the duct 1, they are extended in their forward end in separate planes 13 inclined downwards, facilitating the fall of the products, as seen in FIG. 3.

Likewise, with the aim of preventing possible accidental falls or deliberate ones caused by the machine being pushed by unscrupulous persons, provided in the upper forward part of the duct, in the transverse position, is a stud 12 acting as a stop for the products.

Figure 9:
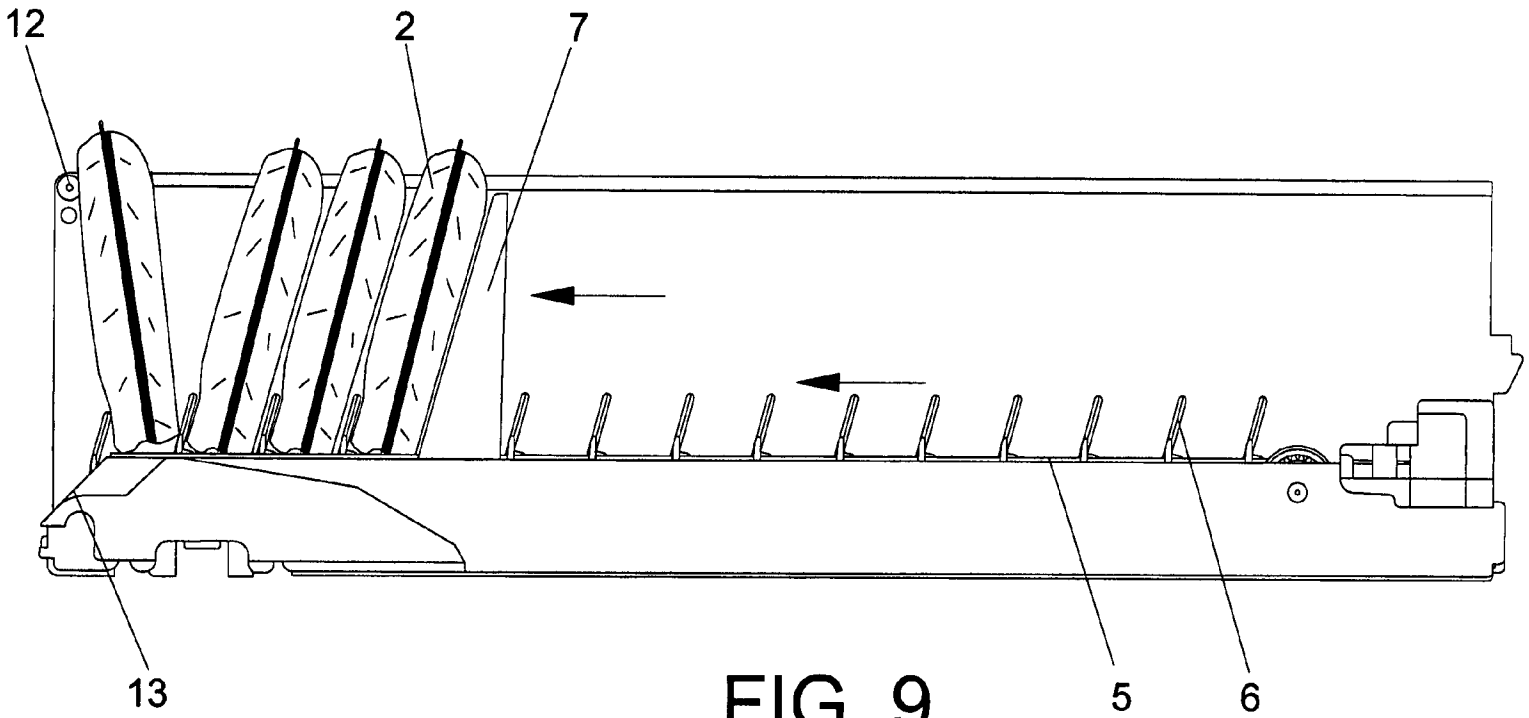
FIG. 9 shows a view in side elevation of the extractor system relative to a duct for storing the products to be dispensed, in which it can be seen how the products cannot fall freely from the duct since they rest between the upper transverse stud and the small lower piece.

In this way, if, due to any action, the products were to swivel towards the front part the first product would run up against the stud 12 which would act as a stop and prevent it from falling. Likewise collaborating for this is the small separator piece, and it can be seen in FIG. 9 how the first product remains supported at the top and bottom so that it cannot fall freely.

Figure 2:
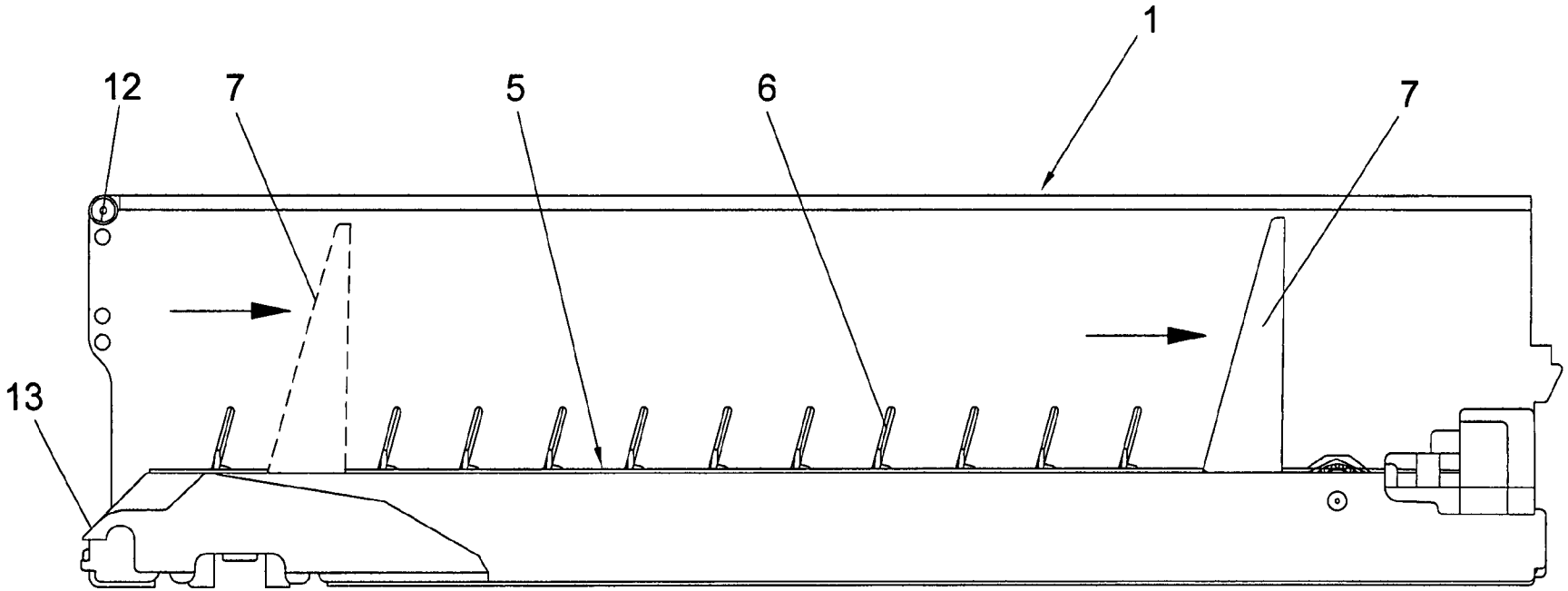
FIG. 2 shows a view in side elevation of the extractor system relative to a duct for storing the products to be dispensed, in which a support body has been represented by a broken line in the forward part of the duct from where it is displaced to the rear part.
Figure 5:
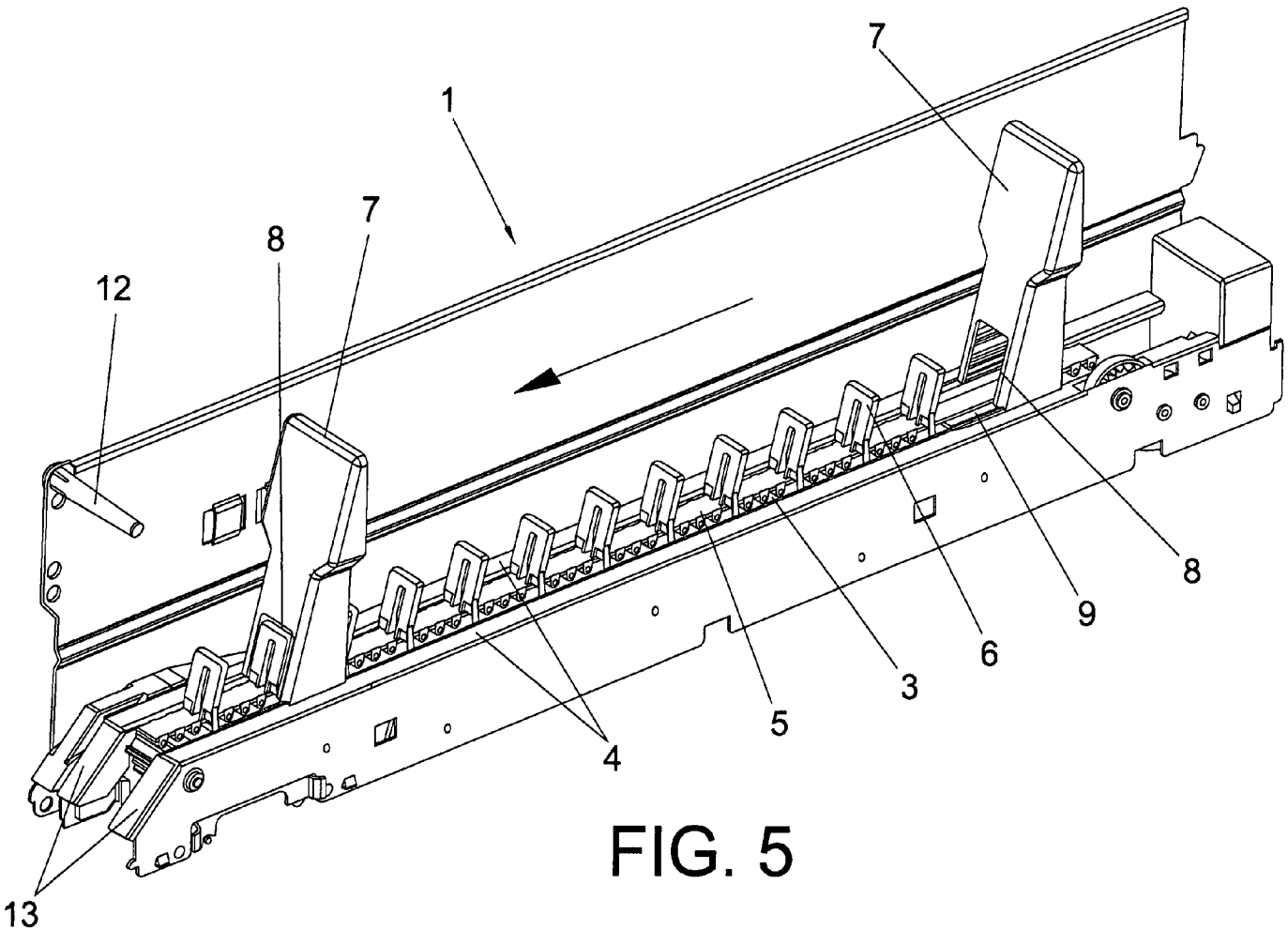
FIG. 5 shows a view in perspective of the extractor system relative to a duct for storing the products to be dispensed, in which it can be seen how a support body for the products (just one is fitted even though two have been represented) presents a window for the passage of the separator pieces in their displacement towards the rear part when the duct is being filled.
Figure 6:
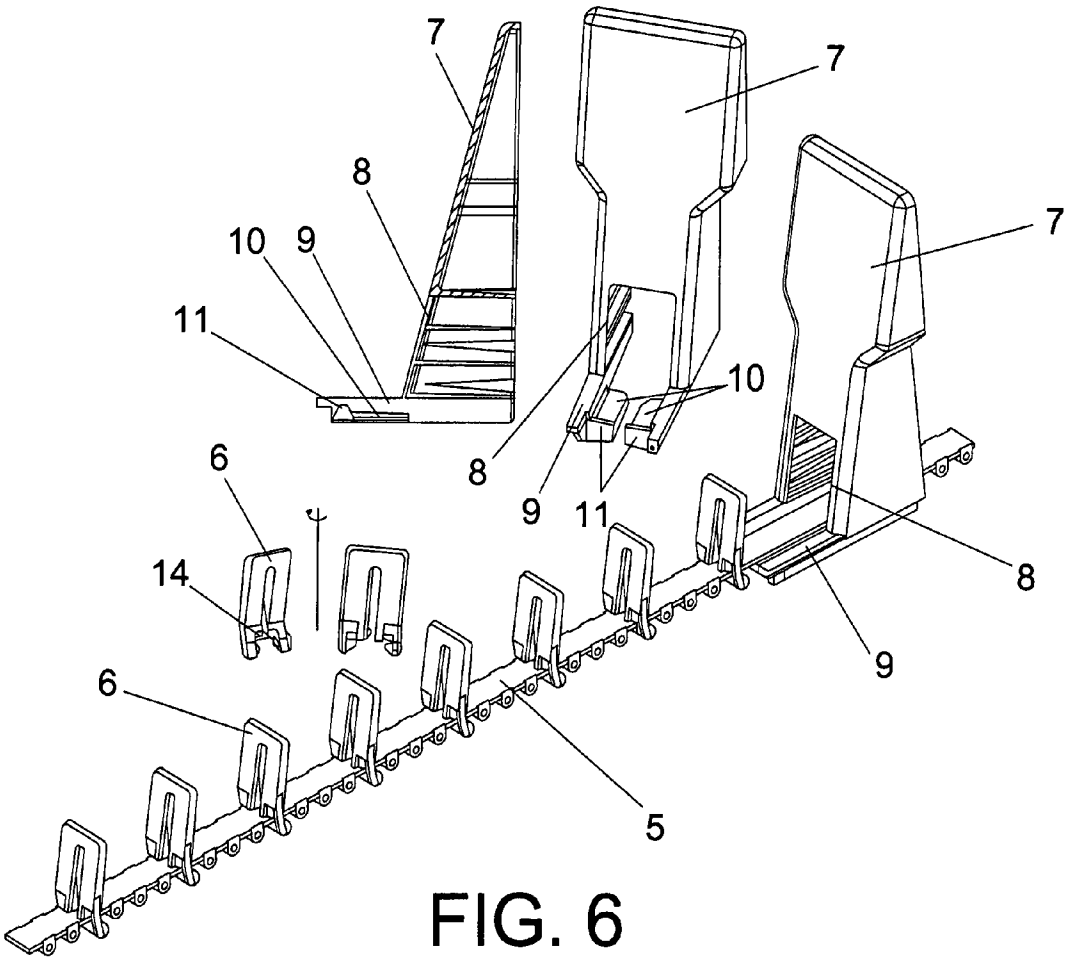
FIG. 6 shows a view in perspective, in detail, of the attachment of the separator pieces and the support body for the products to the traction belt, wherein can be seen the configuration of them both.
Figure 7:
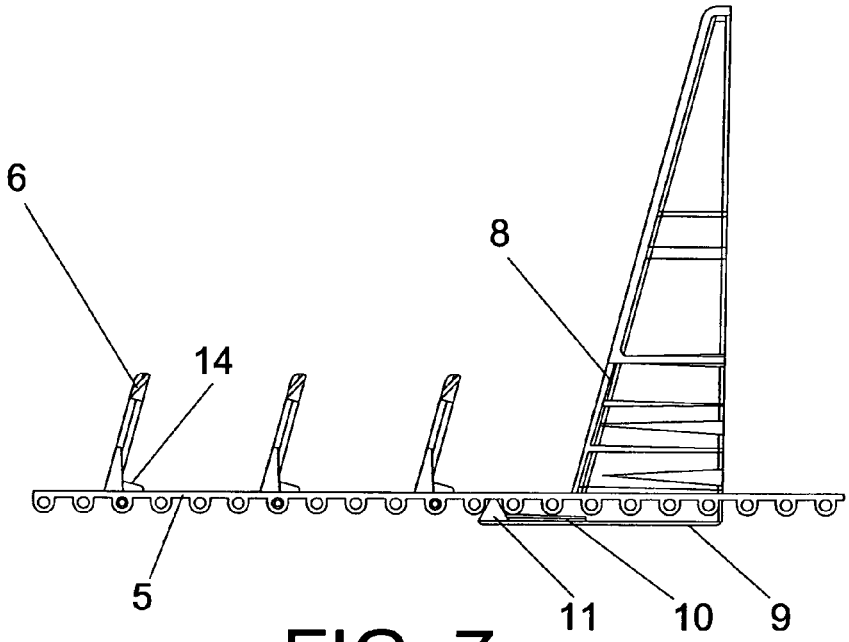
FIG. 7 shows a view in side elevation, in detail, of the attachment of the support body for the products to the traction belt for its pulling.
Figure 8:
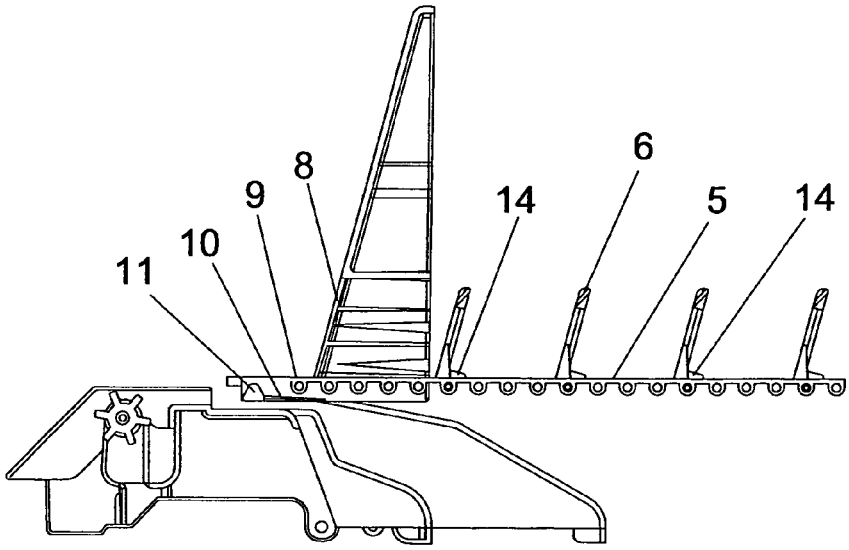
FIG. 8 shows a view in side elevation, in detail, of the position of the support body in proximity to the stop at the forward end of the duct.

Although two support bodies 7 for the products have been represented in FIGS. 2 and 5 for a better understanding, the system incorporates a single support body 7.

The invention claimed is:

1. A UNITARY EXTRACTOR SYSTEM OF PRODUCTS FOR VENDING MACHINES, the extractor system comprising a compartment or duct, having a base, where products are to be stored:

a traction belt mounted in an open central part of the base of the compartment or duct, the traction belt having teeth:

a plurality of small separator pieces, each with a slight inclination towards a rear part of the compartment or duct, respectively joined to the teeth of the traction belt; and a support body for supporting a last product to be dispensed, the support body having a support surface slightly inclined towards the rear part of the compartment or duct, said support body being anchored to the teeth of the traction belt so that, as the traction belt advances, the support body is pulled on lateral surfaces of the base of the compartment or duct, the support body having a central window with a contour slightly larger than that of the small separator pieces; and a transverse stud, provided in an upper forward part of the compartment or duct, for stopping of the products.

2. THE UNITARY EXTRACTOR SYSTEM OF PRODUCTS FOR VENDING MACHINES, according to claim 1, wherein each of the plurality of small separator pieces of the products includes, at a central lower portion thereof, at least one flange for seating on the traction belt, being mounted with a slight inclination towards the rear part of the compartment or duct, in a static position.

3. THE UNITARY EXTRACTOR SYSTEM OF PRODUCTS FOR VENDING MACHINES, according to claim 1, wherein the plurality of small separator pieces of the products are mounted on the traction belt in a vertical position, with the support body having a products resting surface in a position that is likewise vertical.

4. THE UNITARY EXTRACTOR SYSTEM OF PRODUCTS FOR VENDING MACHINES, according to claim 1, wherein the support body of the last product to be dispensed presents laterally and below the central window, elongated flat-bars, as skis, for support on the lateral surfaces of the base of the compartment or duct, presenting in its forward lower part an orthogonal projection towards the interior provided with respective protuberances for fitting between two of the teeth of the traction belt.

5. THE UNITARY EXTRACTOR SYSTEM OF PRODUCTS FOR VENDING MACHINES, according to claim 4, wherein the support body includes lateral flat bars arranged so that, once the last product has been dispensed, forward parts of the lateral flat-bars limit movement of the support body, allowing free rotation of the traction belt.

6. THE UNITARY EXTRACTOR SYSTEM OF PRODUCTS FOR VENDING MACHINES, according to claim 1, wherein the support body includes lateral flat bars arranged so that, once the last product has been dispensed, forward parts of the lateral flat-bars limit movement of the support body, allowing free rotation of the traction belt.

7. THE UNITARY EXTRACTOR SYSTEM OF PRODUCTS FOR VENDING MACHINES, according to claim 1, wherein the support body is arranged so that, in the loading operation with the traction belt in a static state, the support body is manually displaced up to the rear part of the compartment or duct, passing the small separator pieces through the lower central window.

8. THE UNITARY EXTRACTOR SYSTEM OF PRODUCTS FOR VENDING MACHINES, according to claim 1, wherein the transverse stud and a corresponding one of the separator pieces support a first product to prevent free fall thereof.

* * * * *